US005106226A

United States Patent [19]

Fanslow et al.

[11] Patent Number: 5,106,226

[45] Date of Patent: Apr. 21, 1992

[54] WARNING SYSTEM FOR VEHICLES

[76] Inventors: Charles E. Fanslow, R.R. 3, Box 110, Red Wing, Minn. 55066; Mark A. Hollander, Jordan Ave., Apt. #110, Minnetonka, Minn. 55343

[21] Appl. No.: 555,073

[22] Filed: Jul. 18, 1990

Related U.S. Application Data

[63] Continuation-in-part of Ser. No. 458,494, Dec. 28, 1989, abandoned, which is a continuation-in-part of Ser. No. 420,317, Oct. 12, 1989, abandoned.

[51] Int. Cl.[5] ..... E01F 9/00; G08B 3/00

[52] U.S. Cl. ..... 404/15; 404/35; 116/63 P

[58] Field of Search ..... 404/6, 9, 10, 12, 14, 404/15, 16, 35; 49/49, 93, 131; 52/645; 116/63 P, 63 R

[56] References Cited

U.S. PATENT DOCUMENTS

| | | | |
|---|---|---|---|
| 3,254,576 | 6/1966 | Metelka | 404/35 |
| 4,135,839 | 1/1979 | Engwall | 404/16 |
| 4,362,424 | 12/1982 | Barber | 404/6 |
| 4,542,709 | 9/1985 | Spaugh | 116/63 P |
| 4,687,370 | 8/1987 | Knowles | 404/15 |
| 4,813,811 | 3/1989 | Adams | 404/15 |

*Primary Examiner*—Stephen J. Novosad
*Attorney, Agent, or Firm*—John W. Adams

[57] ABSTRACT

A warning system construction for slowing traffic by alerting a driver of impending danger, said construction including a supporting base structure such as a mounting frame having longitudinal spaced apart main frame members and a plurality of cross members fixed to said longitudinal members in longitudinal spaced apart relationship with raised segments mounted on selected cross members to engage the tires of a vehicle to notify the driver of impending danger.

13 Claims, 3 Drawing Sheets

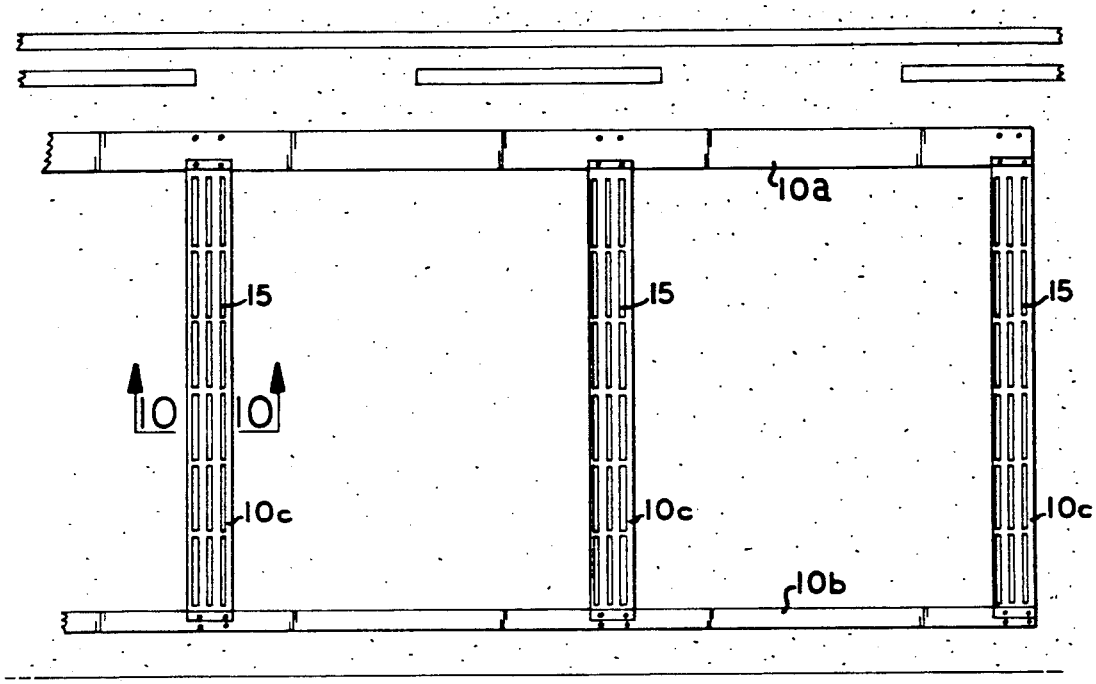
FIG. 9
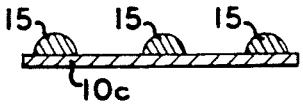
FIG. 10
FIG. 11
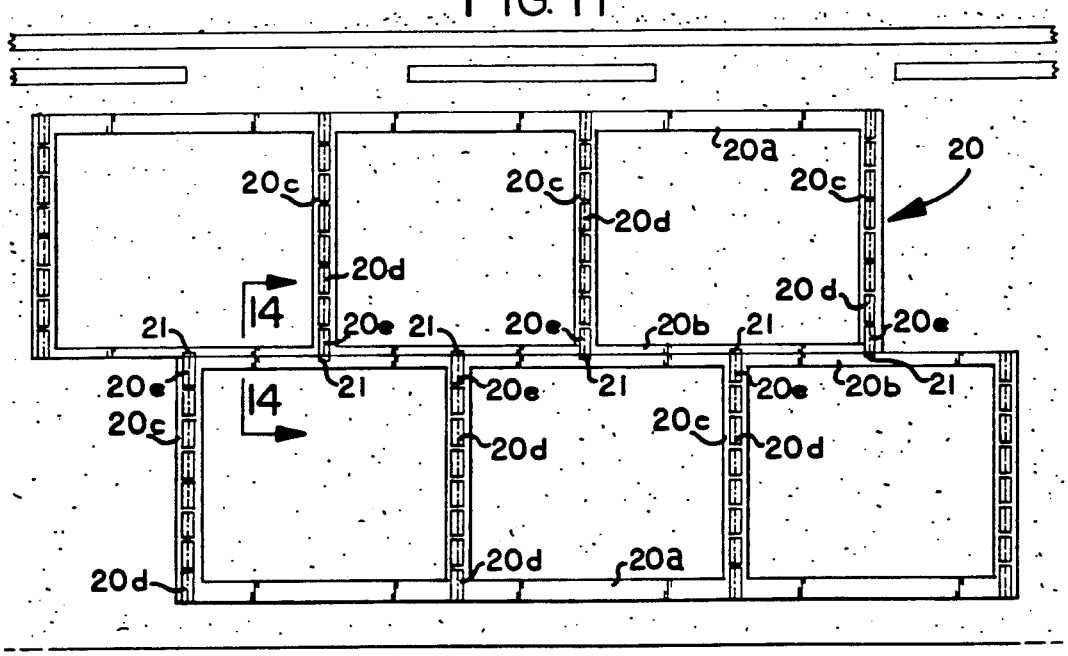

WARNING SYSTEM FOR VEHICLES

This application is a CIP of application Ser. No. 7/458,494, filed Dec. 28, 1989, now abandoned, which in turn is a CIP of applicant's original application Ser. No. 07/420,317 filed Oct. 12, 1989, now abandoned.

Applicants are claiming priority of common subject matter based upon parent applications 07/420,317, filed Oct. 12, 1989 and CIP application 07/458,494, filed Dec. 28, 1989, which is a CIP of original application Ser. No. 07/420,317 filed Oct. 12, 1989 both applications having been filed in the names of Charles E. Fanslow and Mark A. Hollander as the joint inventors of the subject matter of the various claims of both applications which was commonly owned at the time the inventions covered therein or made.

BACKGROUND OF THE INVENTION

In the past, various speed bump safety devices have been invented for the purpose of slowing traffic to prevent killing or injuring highway maintenance and construction workers by alerting a driver to an impending caution situation on the highway. The following is a list of the only prior art patents familiar to the inventor:

| PATENT NO. | ISSUED | PATENTEE |
|---|---|---|
| 4,362,424 | 12/7/82 | Gerald L. Barber |
| 4,342,525 | 8/3/82 | Carl T. Mastronuzzi, Jr. |
| 4,203,685 | 5/20/80 | Richard E. Sanchez |
| 3,065,680 | 11/27/62 | G. P. Wiedman, Sr. |

The first three references disclose various speed bump constructions all of which are relatively complicated and do not disclose a prefabricated multiple bump unit as embodied in this invention. The Wiedman patent shows a stop bumper or barrier which is not designed to permit the vehicle wheel to roll over it as it would be on a highway speed bump construction.

SUMMARY OF THE INVENTION

This invention constitutes a warning system for temporary installation on a highway for warning a motorist of an impending dangerous situation such as a construction zone. The concept includes a supporting base structure adapted to be located in the path of a vehicle on a highway so that the vehicle wheels will engage cross members mounted on the base structure and produce a multiple speed bump unit to notify the operator of danger ahead. The base and cross member assembly may be hinged to fold into a compact unit for easy storage and transportation to the site. The base structure may be made in the form of a frame having cross members with raised ridges made in short slightly spaced apart end to end segments to permit bending of the cross members to accommodate irregularities in the highway surface and lie flat on said surface. It is also contemplated that a "rumble" strip configuration may be provided which includes only a half width base frame structure for engagement with the tires on only one side (usually the right side) of the vehicle to provide an initial warning which is more moderate than the higher speed bump elements which are particularly intended to cover the full width of a traffic lane and engage the wheels on both sides of the vehicle.

DETAILED DESCRIPTION OF THE DRAWINGS

FIG. 9 is a top plan view of still another modification of the invention;

FIG. 10 is a sectional view taken along the line 10—10 of FIG. 9;

FIG. 11 is a top plan view of a modified form of the invention;

DETAILED DESCRIPTION OF THE PREFERRED EMBODIMENT

Figure 1:
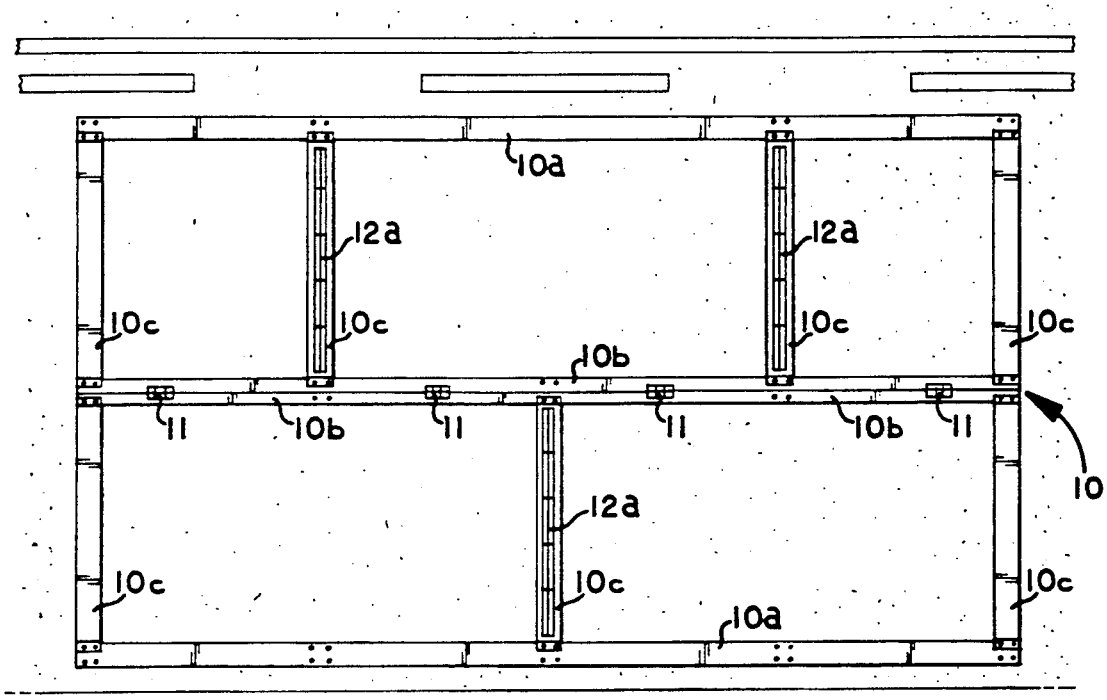
FIG. 1 is a top plan view embodying one form of this invention.
Figure 2:
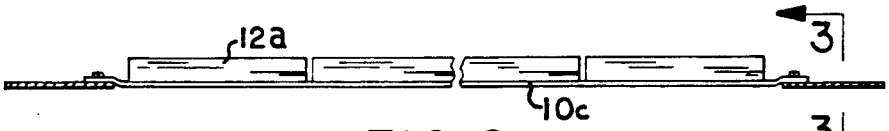
FIG. 2 is a front elevational view of one form of this invention.
Figure 3:
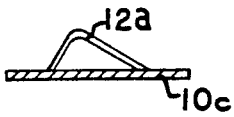
FIGS. 3 through 6 show longitudinal sectional views taken substantially along the line 3—3 of FIG. 2.
Figure 5:
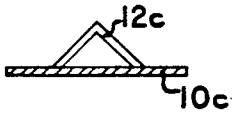

As shown in FIGS. 1–6, one form of the invention embodies a base structure in the form of an frame section 10 having longitudinal members 10*a* and 10*b* with cross-members 10*c* extending therebetween as shown. Selected cross-members 10*c* are provided with raised ridges. Two sections 10 may be hingedly connected to extend across substantially one complete highway lane when in open position. Suitable hinges 11 may be provided for this purpose. The ridges are approximately 1" to 1½" high and are illustrated in a number of different configurations respectively designated by 12*a*, 12*b*, 12*c* and 12*d* in FIGS. 3, 4, 5, and 6 and are securely welded to the selected cross-members 10*c* as illustrated. It has been found that the frame members 10*a*, *b*, and *c* can be satisfactorily manufactured from ferrous metal such as steel straps, members 10*a* and 10*c* may be approximately 6" wide and ¼" thick and members 10*b* may be 3" wide and ¼" thick. The cross-members 10*c* may either be welded or bolted to the longitudinal frame members 10*a* and 10*b* and the hinges 11 may either be welded or bolted to the center frame members 10*b*. The double width hinged units may be approximately 12 feet wide by 20 feet long when laid out on the highway surface. For temporary installation the unit may be merely laid on the surface of the roadway. For long-term installation, suitable anchor bolts 10*d* may be provided to anchor the sections to the highway pavement, as best shown in FIG. 1 and 2.

A continuous ridge and cross-member construction would produce a highly rigid unit which would tend to bridge high spots on the highway surface and produce a "slapping" contact when engaged by a vehicle tire. In order to minimize this problem, the ridges 12*a–d*, 13*a* and 15 are made in relatively short segments of approximately 6 to 9 inches to permit each cross-member to flex and conform to high and low spots on the highway surface and thus permit substantially flat uniform contact with the highway surface across the width of each pair of sections 10 to warn drivers of construction and other danger areas.

Figure 7:
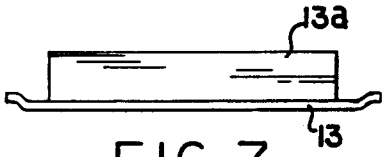
FIG. 7 is a front elevational view of another modification of the invention.
Figure 4:
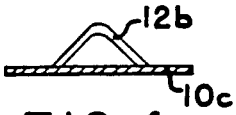
Figure 6:
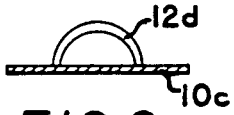
Figure 8:
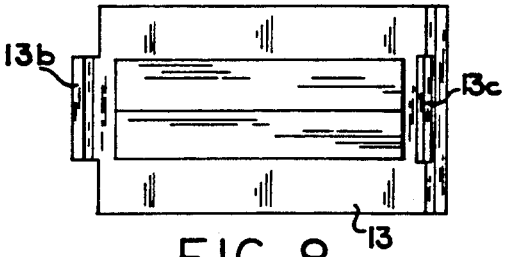
FIG. 8 is a top plan view of the form of the invention shown in FIG. 7.
Figure 12:
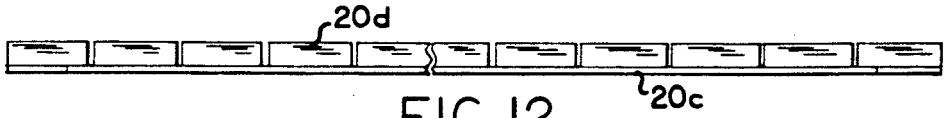
FIG. 12 is a side elevational view thereof.

FIGS. 7 and 8 illustrate a portable model which is small enough and light enough to be carried in the trunk of a highway patrol car and which is adapted to be connected to other similar sections in order to provide a quick and easy to assemble warning unit in case of an accident or some other temporary dangerous condition. In this form, the base structure is a platform 13 which may be an integral unit as shown. A raised cross-member 13*a* is secured to the top of each platform 13. One end of each platform is provided with a bent tongue member 13*b* and the other is provided with a tongue receiving slot 13*c* to permit end to end connection of two or more base platforms 13.

In addition to the speed bump construction shown in FIGS. 1–8, a "rumble strip" can be provided to produce an early warning zone for high speed highway conditions. This "rumble strip" has a low profile and is designed to engage the tires on only one side of the vehicle to produce a early warning "vibration" without effecting the stability of a vehicle traveling at a high speed. A single frame unit 10 is provided having a width to cover slightly less than half the width of a highway lane. The rumble strip cross-members 10*c* are more closely spaced than the speed bump cross-members 10*c* usually approximately five feet apart and each may include three rounded ribs 15 between ¼ inch and ½ inch in height (not more than ⅝" high). The spacing between these cross-ribs 15 may be approximately 3 inches and the rib elements 15 may be made in short half round segments of between 6"–9" in length to permit flexing of the cross members 10*c* to conform to irregularities in the highway surface as in the speed bump segments 12*a–d*.

Figure 14:
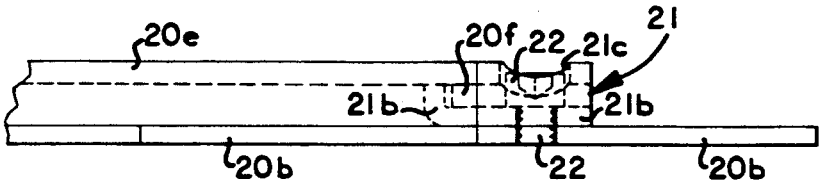
FIG. 14 is a sectional view of a typical connecting joint between adjacent frame sections taken along lines 14—14 of FIG. 11.
Figure 13:
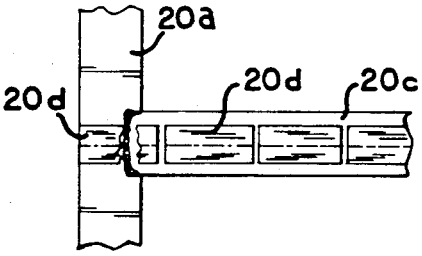
FIG. 13 is a top plan view showing the connection between the cross members and the outer frame members.
Figure 17:
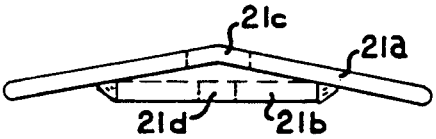
FIG. 17 is a end elevational view thereof.
Figure 15:
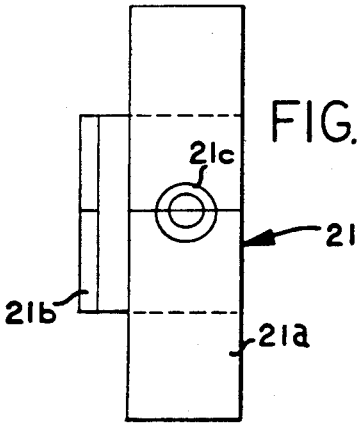
FIG. 15 is a top plan view of a connecting bracket assembly.
Figure 18:
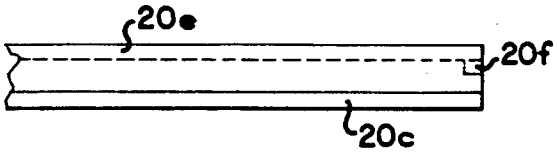
FIG. 18 is a side elevational view of an inner connecting ride segment.
Figure 16:
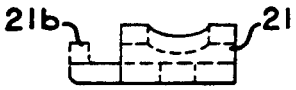
FIG. 16 is a side elevational view thereof.
Figure 19:
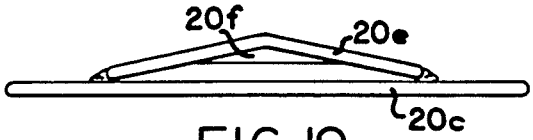
FIG. 19 is an end elevational view thereof.

FIG. 11 shows a modification of the frame structure illustrated in FIGS. 1–8. In this form of the invention, two identical frame units each designated by the numeral 20 are provided. Each unit 20 has an outer longitudinal member 20*a* and an inner member 20*b*. In the form shown, the inner member is one-half the width of the outer member. These two members are rigidly connected by a plurality of cross frame members 20*c* and each member 20*c* has a plurality of ridge sections or segments 20*d* which may be similar to the ridges 12*a* illustrated in FIG. 3. These segments 20*d* are arranged in end-to-end slightly spaced apart relation to each other as described in connection with segments 12*a* and are welded to the top surface of the cross frame members 20*c*. The innermost segments welded to the inner member 20*b* are designated by the numeral 20*e*, as best shown in FIGS. 11 and 13. Each segment 20*e* is provided with a connecting cross web 20*f* welded across the opening of the exposed inner end thereof, as best shown in FIGS. 14 and 17.

A connecting unit 21 is provided for attaching the inner segments 20*e* to the adjacent portion of the longitudinal frame member 20*b* of the adjacent frame section 20. The connecting unit 21 has a top ridge panel 21*a* which conforms to the outer surface of the innermost segments 20*e* to form a continuation thereof. An anchoring hook 21*b* is secured across the underlying dihedral surfaces of the top ridge panel, as best shown in FIG. 17, as being welded thereto. The interlocking portion of anchoring hook 21*b* is provided with sloping surfaces to conform to the underlying dihedral surface of the adjacent ridge segment 20*e* to interlock with the connecting web 20*f*, as best shown in FIG. 14. An opening 21*c* is provided through the top of the ridge panel 21*a* to receive the head of an anchoring bolt 22 therethrough to recess the head below the top surface of the ridge panel, as best shown in FIG. 14. The threaded shank of the bolt extends down through an aligned aperture 21*d* formed through the mounting portion of the anchoring hook 21*b*. The underlying portion of the longitudinal frame member 20*b* is drilled and tapped to permit the connecting unit 21 and cross frame member 20*c* to be securely attached to said frame unit, as best shown in FIG. 14. A connecting unit 21 is provided at the inner end of each cross member 20*c* and forms an extension to the adjacent inner ridge segment 20*e* to overlie a portion of the inner longitudinal frame member 20*b* to provide a series of positive connection between the adjacent sections 20. As stated, the heads of the bolts 22 are recessed below the top of the ridge panels 21*a* of the connecting unit 21.

It is contemplated that the frame units 20 be constructed of 3/16" to ¼" flat bar steel material capable of being welded by conventional welding procedures. This construction has been tested and proved to be satisfactory. The ridge sections 12*a–*12*d* and 20*d* and 20*e* are all securely welded to the underlying cross frame members 10*c* and 20*c*. It is contemplated that the ridges 20*d* and 20*e* will be approximately ½" to ¾" high above the cross frame members 20*b*. The dimensions of each of the frame sections 10 and 20 are approximately 20 feet long by 6 feet wide so that two sections joined together along the longitudinal inner frame members will produce a unit approximately 12 feet wide which will extend across the entire width of a normal highway traffic lane.

As best shown in FIG. 11, the two joined together sections 20 are longitudinally staggered so that the left wheels of a vehicle will contact the cross ridges 20*d* in a slightly out-of-phase timing with the contact of the right wheels of a vehicle contacting cross ridges 20*d* of the adjacent off-set section unit 20. The weight of the steel units has proved to be sufficient to maintain the frame units in position on the highway surface; however, if necessary such as would be the case where lighter material is used such as nylon or other suitable light weight material, conventional lag screws may be provided for attachment to the highway material in which holes and anchors have been provided.

What is claimed is:

1. A vehicle warning system comprising, a base structure adapted to be mounted on a vehicle traffic lane of a highway surface, a plurality of raised bump portions to said base structure transversely of the direction of travel of the vehicle to produce a warning bump when impacted by the tires of a vehicle, wherein the base structure includes a rigid mounting frame having a plurality of spaced apart substantially parallel longitudinal frame members, having a plurality of rigid cross members fixed to the longitudinal frame members and extending therebetween the ridges being mounted on selected cross frame members and extending upwardly a substantial distance above the pavement surface when the mounting frame is laid thereon, and wherein the frame members are constructed of generally flat continuous material and the cross frame members are spaced a sufficient distance apart to permit the tires of a vehicle to contact the pavement in the space provided between the cross frame members and the raised bump portions are securely fixed to selected cross frame members.

2. The structure set forth in claim 1 wherein the flat frame members and the bump portions are formed from steel material wherein the bump portions are welded to the cross frame members.

3. The structure set forth in claim 1 wherein the raised bump portions are formed from a plurality of segments arranged in slightly spaced apart end-to-end relationship to facilitate flexing of the cross frame members.

4. The structure set forth in claim 1 wherein the raised bump portions are in the shape of an inverted "V".

5. The structure set forth in claim 1 wherein the raised bump portions are in the shape of upwardly curved arcuate segments.

6. The structure set forth in claim 1 wherein the mounting frame is hingedly connected to a similar frame to permit compact storage when not in use.

7. The structure set forth in claim 1 wherein the rigid cross frame members are positioned in a plurality of groups, the frame members in each group being more closely spaced than the space between adjacent groups and wherein, the raised portions constitute rib elements fixed to the respective cross members and being less than $\frac{5}{8}$" in height.

8. The structure set forth in claim 7 wherein the rib elements are in the form of half-round segments with the flat side securely respectively fixed to the top surface of the cross frame members.

9. The structure set forth in claim 7 wherein the rib elements are in the form of short spaced apart segments to permit flexing of the cross frame members.

10. The structure set forth in claim 1 wherein a pair of mounting frames are provided in side-by-side relationship to extend across substantially the full width of a single portion of highway, with means for removably connecting adjacent frame members.

11. The structure set forth in claim 10 wherein the ridges are in the form of hollow members having a connecting open-ended cross web fixed across the open-inner end thereof adjacent to the frame to be joined, and a connecting unit fixed to the section adjacent to the open-ended cross web and having connecting means for positively interconnecting the cross web of one section with the adjacent portion of the longitudinal frame member of the adjacent frame section.

12. The structure set forth in claim 11 wherein the connecting unit is in the form of a hook member positioned behind the cross web secured to one section and securely attached to a portion of the side-by-side frame section.

13. The structure set forth in claim 10 wherein raised bump portions of the two sections are staggered to produce alternate impact with the tires on opposite sides of the vehicle.

* * * * *